United States Patent [19]

Kent

[11] Patent Number: 4,733,794

[45] Date of Patent: Mar. 29, 1988

[54] HINGED PLASTIC CONTAINER

[75] Inventor: John R. Kent, Lower Makefield, Pa.

[73] Assignee: Johnson & Johnson Products, Inc., New Brunswick, N.J.

[21] Appl. No.: 507,325

[22] Filed: Jun. 23, 1983

[51] Int. Cl.[4] ..... B65G 65/00

[52] U.S. Cl. ..... 220/306; 220/339

[58] Field of Search ..... 220/306, 334, 337, 339, 220/342, 351

[56] References Cited

U.S. PATENT DOCUMENTS

| | | | |
|---|---|---|---|
| 2,347,724 | 5/1944 | White . | |
| 2,351,783 | 6/1944 | Punte . | |
| 2,492,864 | 12/1949 | Hermani . | |
| 3,695,481 | 10/1972 | Foster et al. . | |
| 4,098,430 | 7/1978 | Mattheis et al. | 220/339 |
| 4,102,452 | 7/1978 | Sato et al. | 220/339 X |
| 4,293,266 | 10/1981 | St. Lawrence et al. | 220/339 |

*Primary Examiner*—Steven M. Pollard

*Attorney, Agent, or Firm*—Wayne R. Eberhardt

[57] ABSTRACT

A container comprising a tubular body members of rectangular cross-section and a hinged lid member having a skirt formed by shallow depending walls adapted to telescope closely over the walls of the body member when the lid is in the closed position, is provided with latching means and a projection on the outside of each side wall of the body member adjacent the open end thereof having an interference fit with the inside surface of the side wall of the lid member, whereby compressive forces are exerted by the lid member on the side walls of the body member as the lid is closed, thereby causing the front wall of the body member to flex slightly to assure the positive engagement of the latching means.

10 Claims, 4 Drawing Figures

HINGED PLASTIC CONTAINER

BACKGROUND OF THE INVENTION

This invention relates to a container with a hinged lid, and more particularly to a lid latching mechanism for rectangular containers constructed of semi-rigid plastic materials.

Containers with hinged lid closure means are old in the art and have been constructed of a variety of materials including metal, cardboard and plastic. Most such containers have included lid latching means in the form of cooperating or interacting projections and/or projections and indentations.

The material of construction of the container has a definite affect on the effectiveness and durability of the lid latching mechanism. Paper or cardboard containers are typically less durable than for example metal containers. Metal containers however, are expensive to fabricate and recent emphasis has been on the fabrication of containers with hinged lid closure means from thermoplastic polymers which may be injection molded at great speed and low cost. Such plastic containers, especially thin, walled, semi-rigid containers, have demonstrated a problem with conventional lid latching mechanisms which had been used successfully on the more rigid metal containers. This has been particularly true in situations where the thermoplastic containers are subjected to elevated temperatures during packing, packaging or use.

It is accordingly an object of the present invention to provide an improved lid latching mechanism for containers with a hinged lid closure. It is a further object of this invention to provide an improved hinged container fabricated of semi-rigid plastic materials. It is a yet further object of this invention to provide an improved lid latching mechanism for containers fabricated by injection molding thermoplastic polymers. These and other objects of the present invention will be apparent from the ensuing description and claims.

SUMMARY OF THE INVENTION

A container comprising a tubular body member of rectangular cross-section and a hinged lid member having a skirt formed by shallow depending walls adapted to telescope closely over the walls of the body member when the lid is in a closed position, is provided with latching means comprising one or more projections on the outside of the front wall of the body member adjacent the open end thereof, and a corresponding one or more interacting projections on the inside of the front wall of the lid member adjacent the lip edge thereof and adapted to engage the wall projections on the body member when the lid is in the closed position, and a further projection on the outside of each side wall of the body member adjacent the open end thereof having an interference fit with the inside surface of the side wall of the lid member, whereby compressive forces are exerted by the lid member on the side walls of the body member as the lid is closed, thereby causing the front wall of the body member to flex slightly to assure the positive engagement of the interacting projections on the front walls of the container.

DETAILED DESCRIPTION OF DRAWINGS

DETAILED DESCRIPTION OF INVENTION

Figure 1:
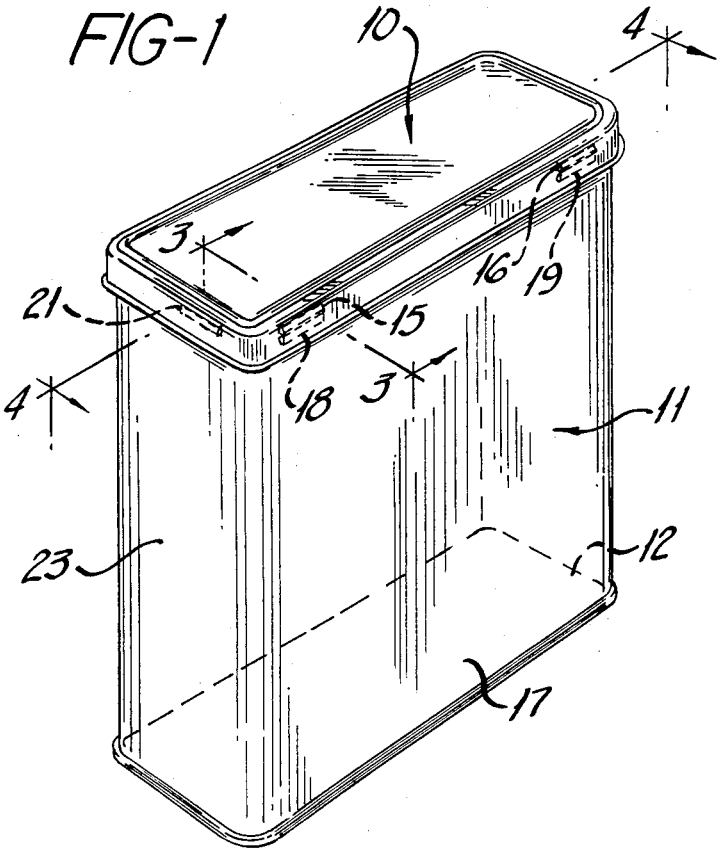
FIG. 1 is a perspective view of a container embodying the present invention with the container lid in the closed position.
Figure 2:
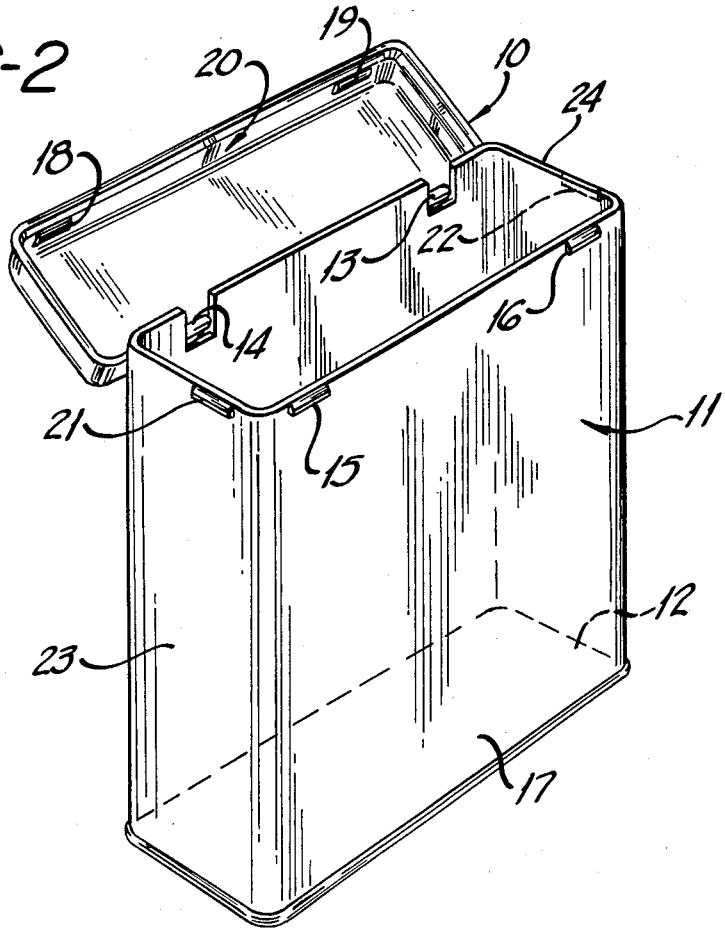
FIG. 2 is a perspective view of the container of FIG. 1 with the lid in the open position.

With reference to the drawings, FIG. 1 illustrates one embodiment of a container of the present invention comprising lid 10 connected by hinge means to tubular body 11 which is of rectangular cross-section and has closed bottom 12. As illustrated in FIG. 2, lid 10 is hinged to the body portion of the container at 13 and 14 to permit the full cross-section of the container body to be uncovered when the lid is in the open position.

Lid 10 and body 11 are fabricated of a semi-rigid material, preferably a resilient plastic material which may be injection molded for economical production. A preferred material is impact-polystyrene. The cover and body are preferably molded separately with snap together hinge components so that the lid may be readily attached to the body of the container subsequent to the molding operation. Alternatively, the body and lid members may be molded simultaneously with an interconnecting integral living hinge.

Container body 11 is provided with a pair of projections 15 and 16 on front panel 17 adjacent the open end thereof substantially as illustrated in FIG. 2. Lid 10 is provided with a corresponding second pair of projections 18 and 19 on the inside of the front depending wall 20 also as illustrated in FIG. 2. The relative positions of the two pairs of projections are such that projections 18 and 19 override and engage projections 15 and 16 when the lid is closed to provide a latching effect as illustrated in the partial cross-sectional view of FIG. 3. While two pairs of projecting lugs are illustrated, a single pair of centrally located and preferably longitudinally extended lugs may also be used.

Figure 3:
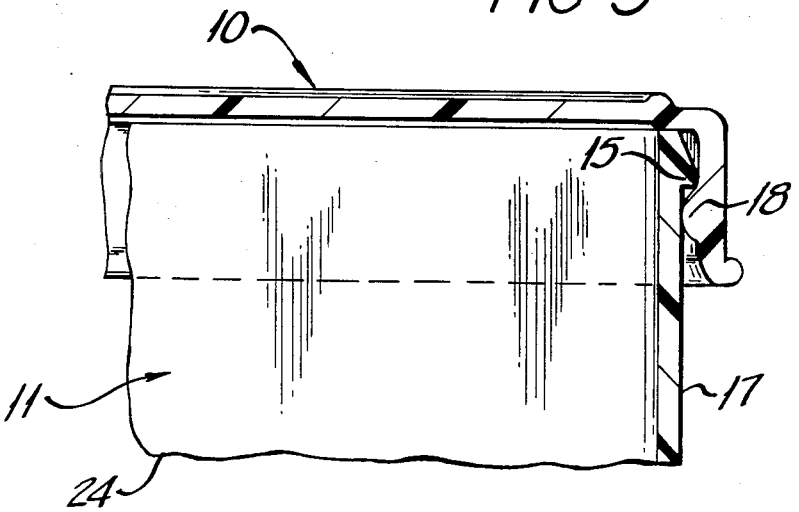
FIG. 3 is a partial fragmentary section taken along line 3—3 of FIG. 1.

As best seen in FIG. 3, projection 15 is angled from the upper edge of front wall 17 to facilitate the override by projection 18 as the lid is closed. Projections 16 and 19 are similarly configured. The lower edge of projection 15 is sharply angled to assure firm engagement with projection 18 when the lid is in the closed position. Projection 18 (and projection 19) has a rounded cross-sectional configuration as illustrated to facilitate its movement past the opposing projection 15 as the lid is opened and closed. A variety of other lug configurations equally operable to serve as a latching mechanism for the lid will be apparent to those skilled in the art and such alternate embodiments are included within the scope of the present invention.

Figure 4:
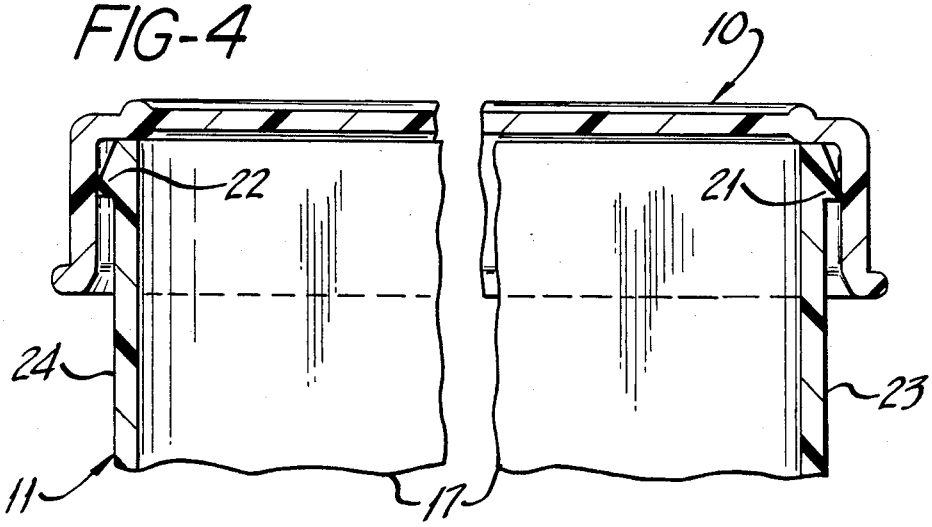
FIG. 4 is a fragmentary section taken along line 4—4 of FIG. 1.

Container body 11 is further provided with projections 21 and 22 on the forward half of side panels 23 and 24 adjacent the open end thereof as illustrated in FIG. 2 and in the fragmentary cross-section of FIG. 4. The side walls of lid 10 are smooth and engage projections 21 and 22 in an interference fit when the cover is in a closed position whereby there is exerted a compressive force on the front wall 17 of the container body. The effect of this compressive force is to cause the edge of wall 17 to bow outward slightly, thereby assuring the positive engagement of projections 15–18 and 16–19.

The inside wall dimensions of lid 10 correspond to the outside wall dimensions of body 11 so that absent the aforedescribed projections, lid 10 would telescope closely over the open end of body 11 with little interference. The side projections 21 and 22 are particularly critical in containers fabricated of thermoplastic polymers such as impact-polystyrene since the combination of stress and temperature experienced during packing, packaging and use may result in some deformation of the body of the container with a consequent loss of latch integrity. Projections 21 and 22 provide a simple and economical means to assure that the front panel of the container body will conform to the configuration desired for secure latching. Projections 21 and 22 may assume various configurations other than that illustrated such as vertical bars or raised circular nodes.

As a further permissible variation of the invention herein, projections 21 and 22 may be incorporated into the lid portion of the container, that is, as projections from the depending side walls of the lid. Such a design is functionally equivalent to that aforedescribed in that the lid exerts compressive forces against the opposing side walls of the container body to cause the lip of the front wall of the body member to flex outward, thereby assuring secure engagement of the front latching means. These and other variations in the details of the present invention will be apparent to those skilled in the art and are considered as part of the present invention.

I claim:

1. In a container comprising a thin-walled, semi-rigid tubular body member of rectangular cross-section having a closed bottom portion, front and rear walls, and opposing side walls defining one open end, a shallow walled rectangular lid member having depending front, rear and opposing side walls adapted to telescope closely over the walls of the body member when in a closed position, and hinge means securing the rear wall of the lid member to the rear wall of the body member adjacent the open end thereof whereby said lid member is pivotable between open and closed positions, the improvement comprising lid latching means comprising one or more first projections on the outside of the front wall of the body member adjacent the open end thereof, cooperating one or more second projections on the depending front wall of the lid member adjacent the lip thereof adapted to override and engage said first projections when the lid is pivoted from an open to a closed position, and a further projection on the outside of each side wall of the body member adjacent the open end thereof having an interference fit with the depending side walls of the lid member whereby when said lid member is pivoted from an open to a closed position, compressive forces are exerted on the side walls of the body member by the lid member.

2. A container of claim 1 wherein said projections on said body member are elongated and parallel to the open end of said body member and angled outward from the open edge thereof.

3. A container of claim 1 wherein said projections on said lid member are rounded in cross-section.

4. A container of claim 1 wherein the projections on the outside of each side wall are angled outward from the open edge thereof.

5. A container of claim 1 wherein a single pair of said first and second projections are centered on the front walls of said body member and said lid member.

6. A container of claim 1 wherein said lid latching means comprises a double pair of said first and second projections positioned to either side of the center of said front walls of said body member and lid member.

7. A container of claim 1 constructed of impact-polystyrene.

8. In a container comprising a thin-walled, semi-rigid tubular body member of rectangular cross-section having a closed bottom portion, front and rear walls, and opposing side walls defining one open end, a shallow walled rectangular lid member having depending front, rear and opposing side walls adapted to telescope closely over the walls of the body member when in a closed position, and hinge means securing the rear wall of the lid member to the rear wall of the body member adjacent the open end thereof whereby said lid member is pivotable between open and closed positions, the improvement comprising lid latching means comprising a first pair of projections on the outside of the front wall of the body member adjacent the open edge thereof, a cooperating second pair of projections on the inside of the front wall of the lid member adjacent the lip thereof and adapted to engage said first pair of projections when said lid is in a closed position, and a projection on the outside of each side wall of the body member adjacent the open edge thereof having an interference fit with the inside surfaces of the side wall of the lid member in a closed position, whereby compressive forces are exerted by the lid member on the side walls of the body member.

9. In a container comprising a thin-walled, semi-rigid tubular body member of rectangular cross-section having a closed bottom portion, front and rear walls, and opposing side walls defining one open end, a shallow walled rectangular lid member having depending front, rear and opposing side walls adapted to telescope closely over the walls of the body member when in a closed position, and hinge means securing the rear wall of the lid member to the rear wall of the body member adjacent the open end thereof whereby said lid member is pivotable between open and closed positions, the improvement comprising lid latching means comprising one or more first projections on the outside of the front wall of the body member adjacent the open end thereof, cooperating one or more second projections on the depending front wall of the lid member adjacent the lip thereof adapted to override and engage said first projections when the lid is pivoted from an open to a closed position, and a further projection on the inside of each depending side wall of the lid member adjacent the lip thereof having an interference fit with the side walls of the body member whereby when said lid member is pivoted from an open to a closed position, compressive forces are exerted on the side walls of the body member by the lid member.

10. In a container comprising a thin-walled, semi-rigid tubular body member of rectangular cross-section having a closed bottom portion, front and rear walls, and opposing side walls defining one open end, a shallow walled rectangular lid member having depending front, rear and opposing side walls adapted to telescope closely over the walls of the body member when in a closed position, and hinge means securing the rear wall of the lid member to the rear wall of the body member adjacent the open end thereof whereby said lid member is pivotable between open and closed positions, the improvement comprising lid latching means comprising a first pair of projections on the outside of the front wall of the body member adjacent the open edge thereof, a cooperating second pair of projections on the inside of the front wall of the lid member adjacent the lip thereof and adapted to engage said first pair of projections when said lid is in a closed position, and a projection on the inside of each depending side wall of the lid member adjacent the lip having an interference fit with the side walls of the body member, whereby compressive forces are exerted by the lid member on the side walls of the body member when the lid is in a closed position.

* * * * *